United States Patent [19]

Racicot

[11] 4,253,210

[45] Mar. 3, 1981

[54] METAL TRUSS STRUCTURE

[76] Inventor: André Racicot, 7765 Gouin Blvd., East, Montreal, Canada, H1E 2A2

[21] Appl. No.: 74,109

[22] Filed: Sep. 10, 1979

[51] Int. Cl.[3] ..... E04C 3/02

[52] U.S. Cl. ..... 14/17; 52/694; 14/13

[58] Field of Search ..... 52/694, 695, 692, 693, 52/691, 639, 690, 655; D25/77, 23; 14/17, 13

[56] References Cited

U.S. PATENT DOCUMENTS

| | | | |
|---|---|---|---|
| 137,482 | 4/1873 | Pratt | 14/13 |
| D. 227,086 | 6/1973 | Johnson | 52/695 |
| 460,856 | 10/1891 | Ferguson | 14/3 |
| 1,924,880 | 8/1933 | Ragsdale | 52/655 |
| 1,924,881 | 8/1933 | Ragsdale | 52/693 X |
| 2,007,898 | 7/1935 | Ragsdale | 52/692 |
| 2,246,215 | 6/1941 | Nagin | 52/694 |
| 2,385,142 | 9/1945 | Lank | 14/13 |
| 2,514,607 | 7/1950 | McLean | 52/693 X |
| 3,131,791 | 5/1964 | Davis | 52/693 X |
| 4,200,946 | 5/1980 | Lawrence | 14/17 X |

FOREIGN PATENT DOCUMENTS

| | | | |
|---|---|---|---|
| 877610 | 8/1971 | Canada . | |
| 1204496 | 1/1960 | France | 52/694 |
| 1416298 | 12/1975 | United Kingdom | 52/693 |
| 449137 | 11/1974 | U.S.S.R. | 52/693 |

*Primary Examiner*—Nile C. Byers, Jr.

[57] ABSTRACT

A metal truss structure which is characterized by chord and web members formed of rectangular tubing and with the chords of double construction to take advantage of the weight and cost savings and high torsional strength of rectangular tubing and arranged for easy and inexpensive fabrication by avoiding precise cutting and difficult welding requirement. This metal truss structure comprises chords, each including a pair of laterally spaced-apart rectangular tubing members positioned flat against opposite sides of the rectangular tubing web members at one corresponding end and welded exclusively by weld lines extending along the longitudinal intersections of the chord members with the web members for simple and automatic welding.

1 Claim, 4 Drawing Figures

METAL TRUSS STRUCTURE

The present invention relates to a metal truss structure.

A metal truss structure essentially includes a pair of spaced-apart chords and web members rigidly joined at their opposite ends to the chords respectively. Many different types of metal trusses have been proposed so far. For instance, in one previously proposed type of metal truss structure, the chords and even the web members are made of angle or tee members. In another previously proposed type of metal truss structure, the chords are each made of a single square tubing and the web members are also of square tubing abutting endwise against the square tubing chord members and welded thereto. In either case, the fabrication of such trusses is time-consuming and relatively expensive due to the precise cutting and fitting required for the web members and to manual welding in places of difficult access.

In the case of trusses made of angles and tees, the latter inherently have a low torsional stiffness greatly limiting the maximum stresses allowable in such members.

In the case of square tubing trusses, an improved performance is obtained, such as reduced weight and costs, increased torsional stiffness and a higher grade steel inherent to rectangular tubing; 50 KSi yield as compared to 44 KSi yield for the angles and tees. However, the square tubing trusses produced so far comprise chords each made of a single square tubing chord member and with square tubing web members arranged in the plane of the opposite chord members and in endwise abutment at the opposite ends with the two chord members respectively.

Such arrangement results in chords which are often subject to overstressing and deformation due to the relatively thin wall of the square tubing and to the practical limitation in the maximum size of the chord members.

It is a general object of the present invention to provide a metal truss structure which substantially avoids the above-mentioned disadvantages.

It is more specifically a general object of the present invention to provide a metal truss structure wherein all the structural members are each proportioned for the stress to which it is subjected and such that every part of the structure is subjected to the same substantially uniform stress of the maximum desired magnitude and to thus utilize only the material that is necessary.

It is another generally stated object of the present invention to provide a metal truss structure which, by efficient use of material, effects considerable savings in material, thus concurrently reducing the costs of the material and of shipping, since both of these are proportional to the weight.

It is a more specific object of the present invention to provide a metal truss structure wherein any compression chord or member is made of rectangular tubing to take advantage of the weight saving and high torsional stiffness inherent to such structural tubing member.

It is another object of the present invention to provide a metal truss structure which is simpler and more economical to fabricate by requiring less precise cutting and allowing easier and automatic welding.

It is a further object of the present invention to provide a metal truss structure which, by doubling of the chord members, allows to build stronger trusses for larger spans and/or heavier loads, as compared to a single chord truss.

The above and other objects and advantages of the present invention will be better understood with reference to the following detailed description of a preferred embodiment thereof, which is illustrated, by way of example, in the accompanying drawing, in which.

Figure 1:
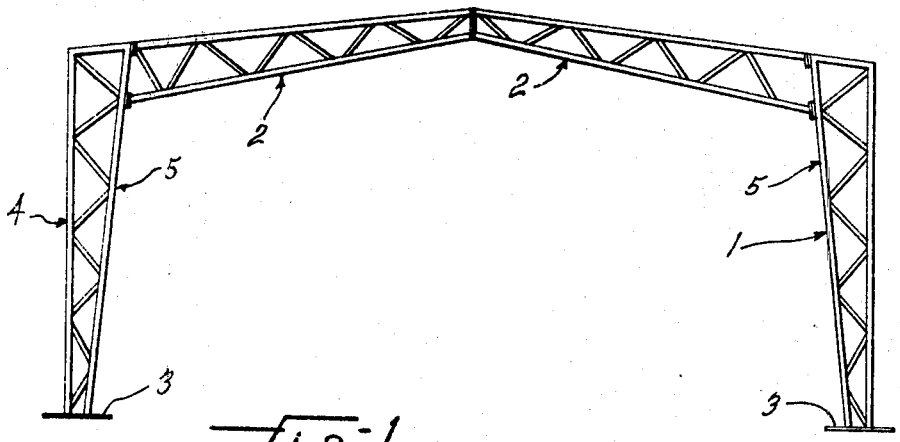
FIG. 1 is a front elevation view of a metal truss structure according to the present invention and defining the transverse outline of a building.
Figure 2:
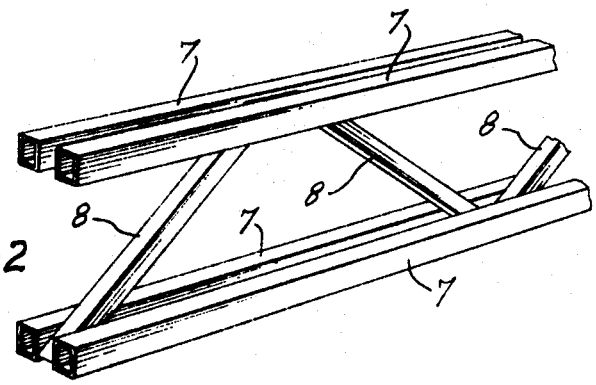
FIG. 2 is a perspective view of part of a metal truss structure according to the present invention.
Figure 3:
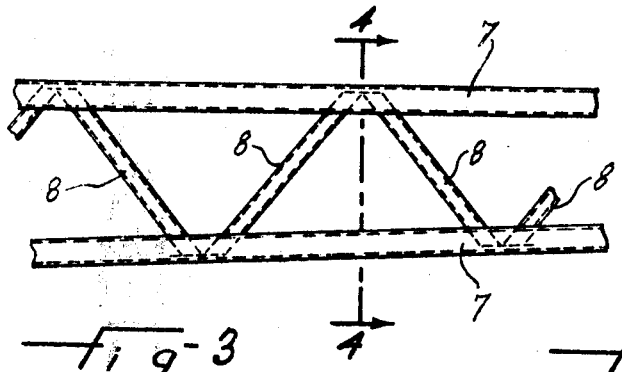
FIG. 3 is a side view of the metal truss structure of FIG. 2.
Figure 4:
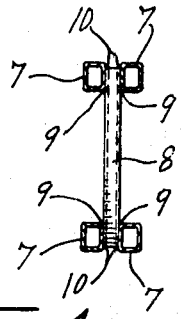
FIG. 4 is a cross-sectional view as seen along line 4—4 in FIG. 3.

In FIG. 1, there is illustrated a metal truss structure formed of a pair of upright wall sections 1 and a pair of roof sections 2. Each truss section 1 has its narrower end resting on ground plates 3, its outer chord 4 extending vertically and its inner chord 5 upwardly extending inward. The roof sections 2 have their narrower and fixed endwise one to the other at the roof line and have their larger end fixed to the inner chord 5 of the corresponding wall section.

Each metal truss structure or section 1 or 2 has each of its two chords made of double construction; that is, having two chord members 7. The two chord members 7 of each chord are laterally spaced apart one from the other and separated by the web members 8.

Each chord member 7 and web member 8 is of rectangular tubing and the chord members 7 are fixed flat against opposite sides respectively of the web members 8 and at the opposite ends of the web members.

Both ends of web members 8 are cut so as to extend substantially parallel to chord members 7.

The chord and web members 7 and 8 are welded one to another by weld lines 9 and 10 at the inner side and outer side of chord members 7, respectively, said weld lines extending along all the longitudinal extensions between the chord members 7 and the web members 8. Thus, all the weld lines extend longitudinally of the truss structure and may be automatically produced.

What I claim is:

1. A lattice girder comprising two spaced elongated chords, each including a pair of laterally spaced-apart, parallel, rectangular tubing chord members and web members rigidly interconnecting said chords, and serially spaced apart from one another along said chords, each web member consisting of a straight rectangular tubing web member, of uniform cross-section throughout its length and having its end portions extending between and applied flat against opposite inner faces of the rectangular tubing chord members, both ends of each rectangular tubing web member being cut so as to extend substantially parallel to the rectangular tubing chord members, and weld lines securing said end portions of said web members to each of said rectangular tubing chord members, said weld lines extending at the inner and outer sides, respectively, of said chord members along all the longitudinal extensions between said rectangular tubing chord members and said web members, said weld lines extending longitudinally of said chords and at two spaced zones longitudinally of each web member.

* * * * *